US005809760A

United States Patent [19]

Rexroat

[11] Patent Number: 5,809,760

[45] **Date of Patent: *Sep. 22, 1998**

[54] UNIVERSAL BLADE RAKE

[76] Inventor: William G. Rexroat, 7760 N. 1200th Rd., Colchester, Ill. 62326

[ * ] Notice: The terminal 15 months of this patent has been disclaimed

[21] Appl. No.: 451,995

[22] Filed: May 26, 1995

[51] Int. Cl.[6] ..... A01D 7/06

[52] U.S. Cl. ..... 56/400.05; 56/400.07; 172/777

[58] Field of Search ..... 56/400.04, 400.05, 56/400.07, 400.01; 172/784, 777, 778, 772

[56] References Cited

U.S. PATENT DOCUMENTS

| | | | |
|---|---|---|---|
| 2,221,906 | 11/1940 | Birk | 172/777 X |
| 2,566,547 | 9/1951 | Bartlett | 172/777 |
| 3,335,557 | 8/1967 | Boyer | 172/777 |
| 5,452,570 | 9/1995 | Schmid | 56/400.07 |

FOREIGN PATENT DOCUMENTS

| | | | |
|---|---|---|---|
| 583941 | 9/1959 | Canada | 172/777 |
| 631994 | 12/1961 | Canada | 172/777 |

*Primary Examiner*—Terry Lee Melius

[57] ABSTRACT

An attachment is usable in combination with any conventional moldboard and provides a rake accessory unit for said moldboard. The rake attachment consists of a steel mounting plate, upon which a plurality of cylindrical steel tines, equally spaced, cut to a uniform length, the majority of which are welded to the mounting plate, and the remainder that extends below the the lower edge of the mounting plate, provides a rake configuration. The rake attachment is mountable in front of the moldboard, and the depth of the tines when used for grading the roads or recovering gravel from the turf, can be adjusted by conventional skid shoes, or by the hydralic lift systems commonly used on tractors.

3 Claims, 2 Drawing Sheets

UNIVERSAL BLADE RAKE

CROSS-REFERENCE TO RELATED APPLICATIONS

The following U.S. and Canadian patent is cited, but is not believed pertinent.

| U.S. Pat. No. | Date | Inventor | Title |
|---|---|---|---|
| 583,941 | Sept. 29, 1959 | Sharp | Moldboard Blade Attachment |

Sharp presents a rake attachment for a moldboard/blade, however the construction characteristics are different; Sharp uses two arcuate mounting staps, upper and lower rod members, with sleeve and like tooth elements welded between said rod members. Whereas with the present invention consists of a single steel mounting plate, with cylindrical steel tines welded thereon.

BACKGROUND OF THE INVENTION

1. Field of the Invention

This invention relates to road maintenance equipment and more importantly to gravel roads or driveways, using moldboard/blades on conventional motorized road graders, tractor graders equiped with three point hitch hydralic lift systems, front end loaders, garden tractor moldboards, and the like.

2. Description of Prior Art

The conventional moldboard/blade, (hereinafter referred to as moldboard unless otherwise stated), used on rear mounted grader attachment for tractors equiped with three point hydralic lift systems, with adjustments for tilt and angle of the moldboard, are not too effective in recovering road rock or gravel that has accumulated in the grass or other vegatation growing on the shoulders and ditches. Following winter snow removal, heavy rains, or from normal useage of the roads, the moldboard will tend to slide over the grass, leaving much of the gravel or embedding it further into the turf.

SUMMARY

The invention presents a rake attachment for use in combination with a conventional moldboard, consisting of a steel mounting plate, (hereinafter referred to as the mounting plate unless otherwise stated), cut to a length and width of certain dimensions, upon which a plurality of equally spaced steel tines are cut to uniform length, the longer portion of which are attached by welding for example, to one side of the mounting plate, the shorter portion thereof extending below the bottom edge of the mounting plate, forms the rake section.

The welded portion of the tines add rigid support to the mounting plate, and the tines tend to hold the gravel on the universal blade rake, until the gravel accumulates to the top of the tines.

The primary object of this invention is to provide a rake accessory unit for a conventional moldboard/blade, whether said moldboard is pushed or pulled. This invention improves the method of recovering the gravel from the shoulders and ditches of the roadway.

The Universal Blade Rake, (hereinafter referred to as the blade rake unless otherwise stated), when used in conjunction with the moldboard, rakes the gravel from the grass, back onto the roadway, without removing the top soil or pulling up the turf.

By attaching conventional skid shoes, in combination with the three point hydralic lift system on the tractor, the penetration of the blade rake tines into the turf can be adjusted from zero to nearly full length of the tines.

DESCRIPTION OF THE PREFERRED EMBODIMENT(S)

Figure 1:
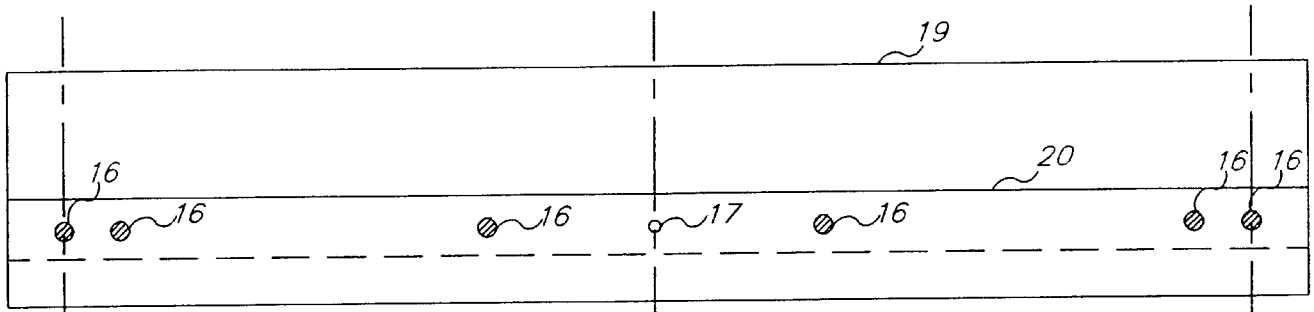
FIG. 1 (PRIOR ART)
FIG. 1 is a front view of a conventional moldboard/blade, that is labled Prior Art.

Referring to FIG. 1, the conventional moldboard 19 and blade 20, are attached by six flat headed bolts 16. The dashed line indicates the bottom edge of the moldboard 19 where it overlaps the rear side of blade 20. A new hole 17, is drilled at the center of the moldboard 19 and blade 20 in line with bolts 16, to facilitate attachment of the blade rake, FIG. 2. Note: (hereinafter the moldboard 19 and blade 20, will be referred to as moldboard 19, unless otherwise stated.)

Figure 2:
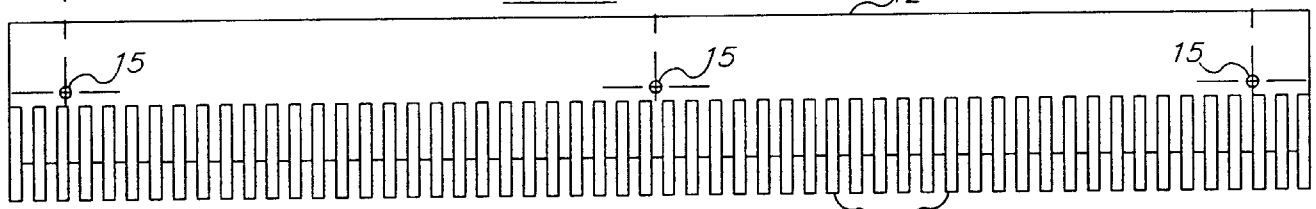
FIG. 2 is a front view of the blade rake.

The blade rake FIG. 2, consists of a steel mounting plate 12, the first preferred embodiment, cut to a length equal to that of the moldboard 19, and to a width approximately one half the width of moldboard 19.

Three holes 15, drilled in the steel mounting plate 12, (hereinafter referred to as the mounting plate 12) are aligned on center with the two outer bolts 16, FIG. 1, and hole 17, FIG. 1, so that the bottom edge of the mounting plate 12, FIG. 2, is even with the bottom edge of blade 20, FIG. 1. Three hex bolts 14, FIG. 4, attach the blade rake FIG. 2, to moldboard 19, FIG. 1.

A plurality of cylindrical steel tines 13, the second preferred embodiments are cut from steel rods to a uniform length; the longer length of which are welded to the front side of the mounting plate 12, FIG. 2, and the remaining shorter part thereof extending below the bottom edge of the mounting plate 12, forms the rake-section of the blade rake FIG. 2.

Figure 4:
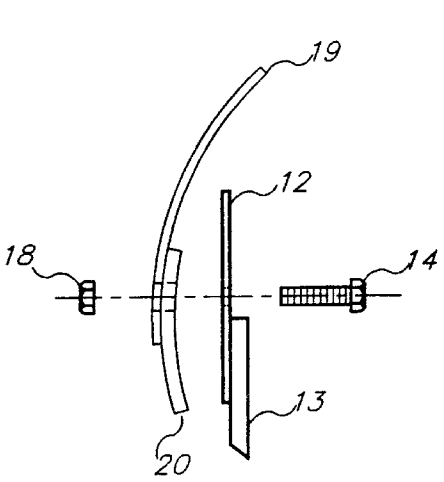
FIG. 4 is a fragmentary end view of the blade rake and the moldboard/blade.
Figure 3:
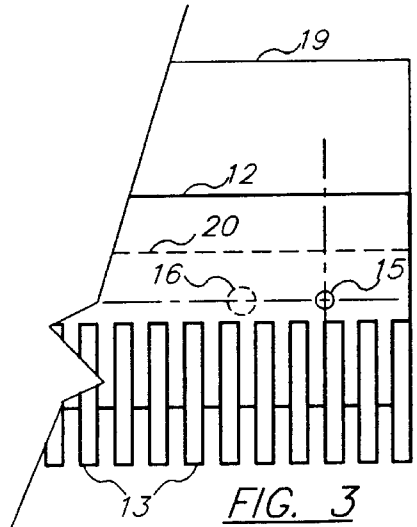
FIG. 3 is an enlarged fragmentary right front view of the blade rake attached to the moldboard.
Figure 5:
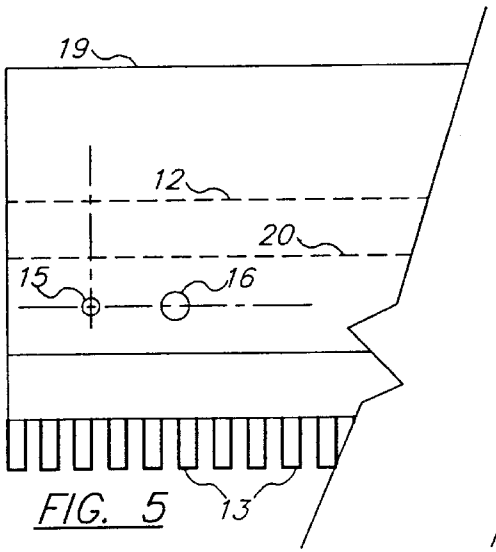
FIG. 5 is an enlarged fragmentary left rear view of the blade rake attached to the moldboard.

Illustrated in FIG. 4, the mounting plate 12 has a planar configuration, and the tines 13 are beveled from the forward side to the back side of each tine. The gauge of the mounting plate 12, and the diameter of the tines, will vary dependent on the particular work application. The number of tines 13 needed are dependent on the spacing and their diameter, and the length of the blade rake, FIG. 2.

Figure 6:
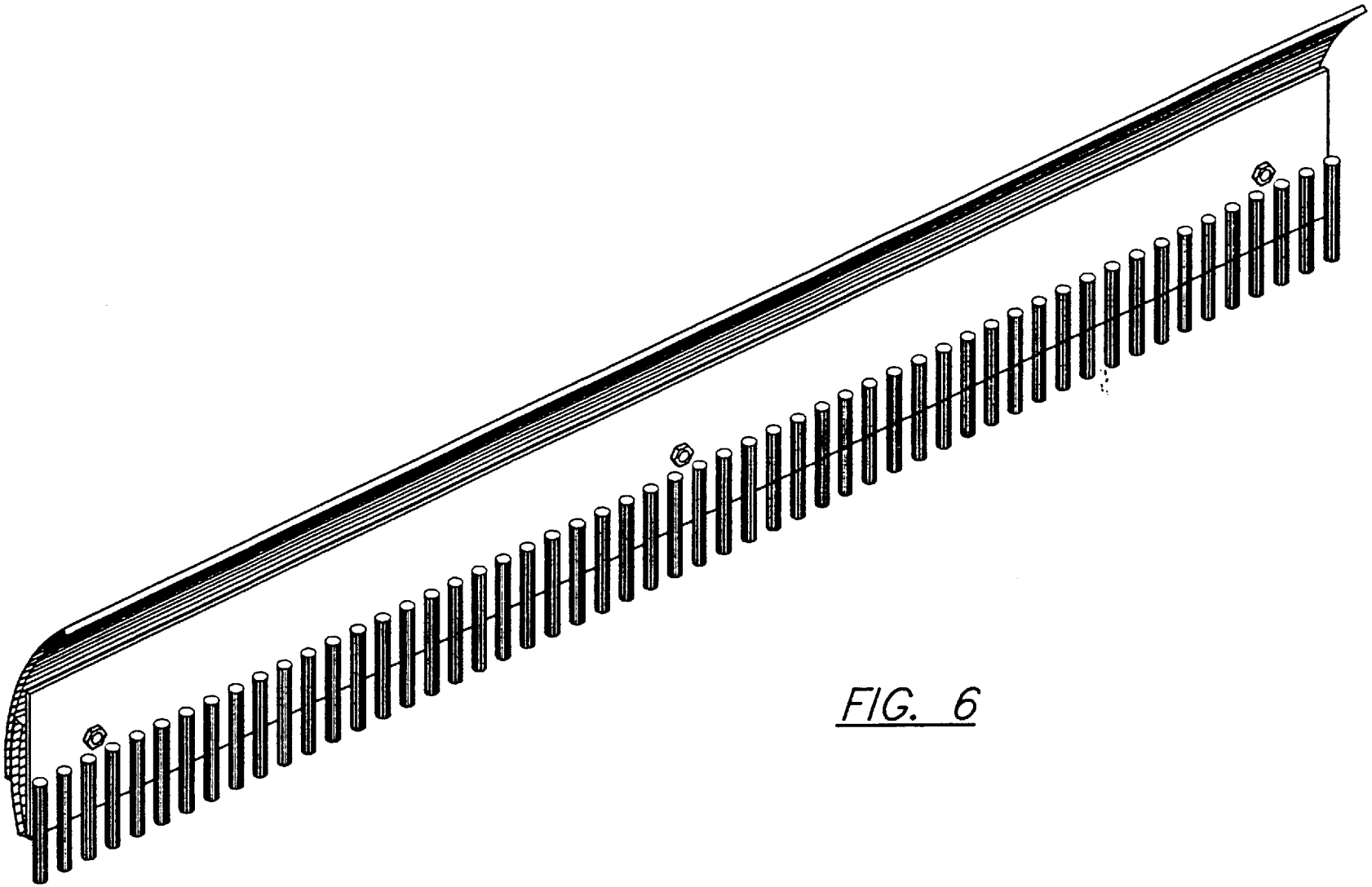
FIG. 6 is a composite view of the blade rake attached to the moldboard/blade.

FIG. 6, shows the blade rake FIG. 2, attached to the moldboard FIG. 1, providing a rake attachment that overcomes the difficulties of the moldboard per se.

Since numerous modifications and changes can be made with this invention, the principles of the invention, are not limited to the foregoing descriptions of the blade rake, e.g., the tines can be bolted, riveted, or welded to the blade rake, FIG. 2.

Having fully described the invention, what I claim as new are as follows:

1. A rake attachment for a moldboad, said moldboard having an arcuate configuration and a blade member attached thereto, said rake attachment including:

a mounting plate, said mounting plate having a planar configuration and extending across the width of the blade member, attachment means for attaching said mounting plate to said moldboard and a plurality of steel tines, each said steel tine being welded to the mounting plate such that a majority of the overall length of the steel tine is welded to the mounting plate and a remainder of the steel tine extends beyond a lower edge of the mounting plate, thereby providing a rake configuration.

2. The rake attachment as claimed in claim 1, wherein said tines are cylindrical.

3. The rake attachment as claimed in claim 1, wherein a lower end of each said tine is beveled.

* * * * *